US005227692A

United States Patent [19]

Lee

[11] Patent Number: 5,227,692

[45] Date of Patent: Jul. 13, 1993

[54] MAGNET ASSEMBLY FOR CORRECTING CRT MISCONVERGENCE

[75] Inventor: Sunhaeng Lee, Seoul, Rep. of Korea

[73] Assignee: Samsung Electron Devices Co., Ltd., Kyunggi, Rep. of Korea

[21] Appl. No.: 692,275

[22] Filed: Apr. 26, 1991

[30] Foreign Application Priority Data

Oct. 24, 1990 [KR] Rep. of Korea ..... 90-16288

[51] Int. Cl.[5] ..... H01J 29/70

[52] U.S. Cl. ..... 313/431; 313/437; 313/428; 313/412; 335/212; 335/214; 358/249

[58] Field of Search ..... 313/431, 437, 428, 412, 313/154, 156; 335/212, 214; 358/249

[56] References Cited

U.S. PATENT DOCUMENTS 2,791,709 5/1957 Landes et al. ..... 335/212
4,468,587 8/1984 Sluyterman ..... 313/431

FOREIGN PATENT DOCUMENTS 0853823 10/1970 Canada ..... 313/428
0023937 2/1985 Japan ..... 313/431
2086130 5/1982 United Kingdom ..... 313/431

*Primary Examiner*—Donald J. Yusko
*Assistant Examiner*—N. D. Patel
*Attorney, Agent, or Firm*—Christie, Parker & Hale

[57] ABSTRACT

A convergence correcting magnet assembly means for adjusting the position of plural correcting magnets closer to or further from electron beams in a cathode ray tube, preferably comprising four bipolar magnets arranged in two offset pairs, one pair oriented in the lateral direction and a second pair in the longitudinal direction; the pairs of magnets permit laterally and longitudinally deviating beams to be adjusted or converged toward the center beam. Preferably, each of the bipolar magnets is installed in a clearance space having a spring-loaded or elastic member and an adjusting member, so that the intensities of each magnet can be adjusted by individually moving each magnet closer to or further from the beams under spring tension. Interactions between the magnets are minimized by isolating the magnets from one another.

11 Claims, 4 Drawing Sheets

MAGNET ASSEMBLY FOR CORRECTING CRT MISCONVERGENCE

FIELD OF THE INVENTION

The present invention generally relates to a device for improving the convergence characteristics of electron beams in in-line type color cathode ray tubes, and specifically relates to an adjustable convergence correcting magnet assembly in which the attachment and shape of the magnet assembly is improved, and which permits fine adjustment of the deflection field strength.

BACKGROUND OF THE INVENTION

In the usual color cathode ray tube, three electron beams (designated R, G, B beams for the colors red, green, and blue) shot by an electron gun are controlled to move across the tube screen in the required direction by magnetic fields generated in a deflection yoke. Then, the beams pass through apertures in a shadow mask, and collide with phosphor dots formed on the screen, thereby forming pictures.

However, sometimes the center axis of the coil assembly of the deflection yoke does not correspond to the center axis of the electron beam. Moreover, sometimes the strength and characteristics of the electron beams are not uniform due to imperfect distribution by the electron gun. Due to these and other factors, the three electron beams may fail to converge properly at the central portion of the picture, a phenomenon called misconvergence which causes color misalignment, thereby deteriorating the picture quality.

In an attempt to correct such misconvergence, Japanese Utility Model Publication No. Sho 58-99755 proposes a method in which the winding method for the coil of the deflection yoke is modified.

Another convergence correction method is known, using a color purity enhancing magnet or a ring magnet having multiple poles attached on the circumference of the holder portion of the CRT deflection yoke, so that the position of the electron beams can be adjusted by the magnetic fields of the ring magnet, thereby obtaining high quality convergence.

Conventionally, ring magnets having 4 or 6 poles are attached around the color purity enhancing magnet on the holder portion of the deflection yoke, and this assembly is attached on the neck portion of the cathode ray tube in order to obtain high quality convergence. However, in this type of magnet convergence correction device, the flux densities of the magnets are fixed at a predetermined level, and therefore, obtaining a precise convergence correction is difficult because the beams may drift over time. It is also difficult to maintain the beams in a corrected position because the ring magnet can rotate and the correction is not precise.

SUMMARY OF THE INVENTION

Therefore, one object of the present invention is to provide a convergence correcting magnet assembly in which a means is added for adjusting the position of the correcting magnet closer to or further from the beams, so that the convergence correcting magnetic field can be precisely adjusted.

In achieving the above object, a convergence correction magnet assembly according to the present invention provides four bipolar magnets, arranged in two offset pairs, one pair oriented in the lateral direction and a second pair in the longitudinal direction. The pairs of magnets permit laterally and longitudinally deviating beams to be adjusted or converged toward the center beam. Preferably, each of four bipolar magnets are installed in a clearance space having an elastic member or spring and an adjusting member, so that the intensities of each bipolar magnet in FIG. 1 can be adjusted by individually moving each magnet closer to or further from the beams.

Further, interactions between the magnetic field of the lateral correcting magnet and the magnetic field of the longitudinal correcting magnet are minimized by isolating the magnets from each other.

BRIEF DESCRIPTION OF THE DRAWINGS

The above object and other advantages of the present invention will become more apparent in the following description of the preferred embodiment of the present invention with reference to the attached drawings in which.

DETAILED DESCRIPTION

In the following description, certain specific technical terms are used for the sake of clarity. However, the invention is not confined in scope to the terms selected, but rather covers all subject matter defined by the appended claims.

Figure 4A:
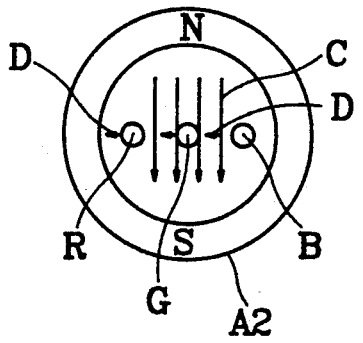
FIG. 4A(Prior Art)
FIGS. 4A, 4B, and 4C are front schematic views of a yoke assembly which illustrate deflections of electron beams by magnetic fields of conventional color purity enhancing ring type magnets.
Figure 4B:
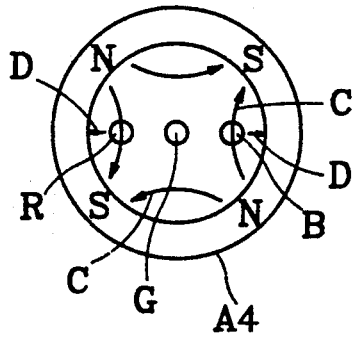
FIG. 4B(Prior Art)
Figure 4C:
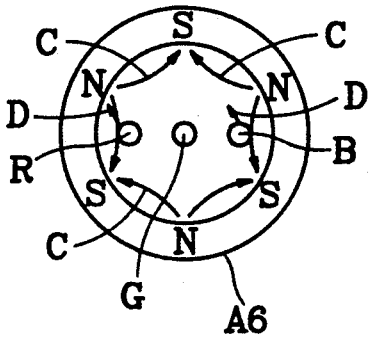
FIG. 4C(Prior Art)

Attention is first invited to the schematic diagrams of FIGS. 4A, 4B, and 4C, which illustrate prior apparatus for correcting misconvergence of electron beams in a cathode ray tube, by using multipolar permanent magnets A2, A4, A6 of fixed flux density mounted a fixed distance from the beams. Specifically, FIG. 4A illustrates that, if a magnetic field flowing in the direction of arrows C is established by a conventional bipolar color purity enhancing ring magnet A2, electron beams R, G, B are deflected in the direction of arrows D, i.e., in the leftward direction. FIG. 4B illustrates that, if a magnetic field flowing in the direction of arrows C is established by a correcting ring magnet A4 having quadruple poles, electron beams R, B, which are disposed outwardly, are deflected in the outward direction of arrows D, however, beam G is not affected. FIG. 4C illustrates the phenomenon that, if a magnetic field flowing in the direction of arrows C is established by a correcting ring magnet A6 having 6 poles, the electron beams R, B are deflected in the upper leftward direction of arrows D.

However, deflection effects illustrated by arrows D of FIGS. 4A to 4C are fixed in angle and intensity, because the location of magnets A2, A4, A6 is fixed with respect to beams R, G, and B. The present invention overcomes this limitation by providing adjustable convergence correction magnets using the structures described below.

Figure 1:
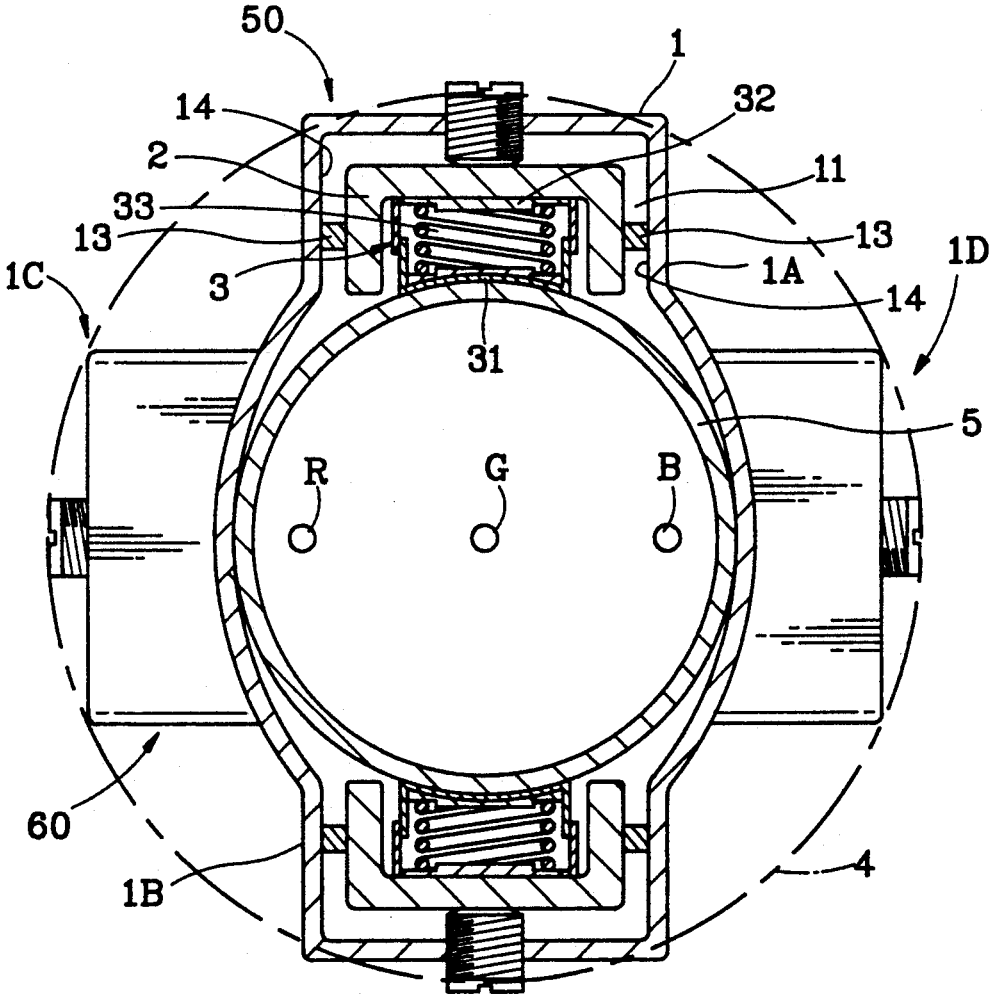
FIG. 1 is a front section view of the convergence correcting magnet assembly of the present invention.

FIG. 1 is a front section view of a convergence correcting magnet assembly according to the present invention. The convergence correcting magnet assembly according to the present invention comprises four magnet units 1A, 1B, 1C, 1D of FIG. 1. As shown in FIG. 1, each unit 1A–1D has a correcting magnet clearance space 11 defined by and located between a convergence correcting magnet supporting member 1 and electron gun holder 5. Adjusting means 12, 12' (FIG. 2) for applying pressure on a convergence correcting magnet (to be described later) is provided in the outer portion of the accommodating spaces 11, respectively. A bipolar magnet 2 is installed between each adjusting means and a compressible element 3. Adjusting means 12' is constructed in the same manner as adjusting means 12.

Figure 2:
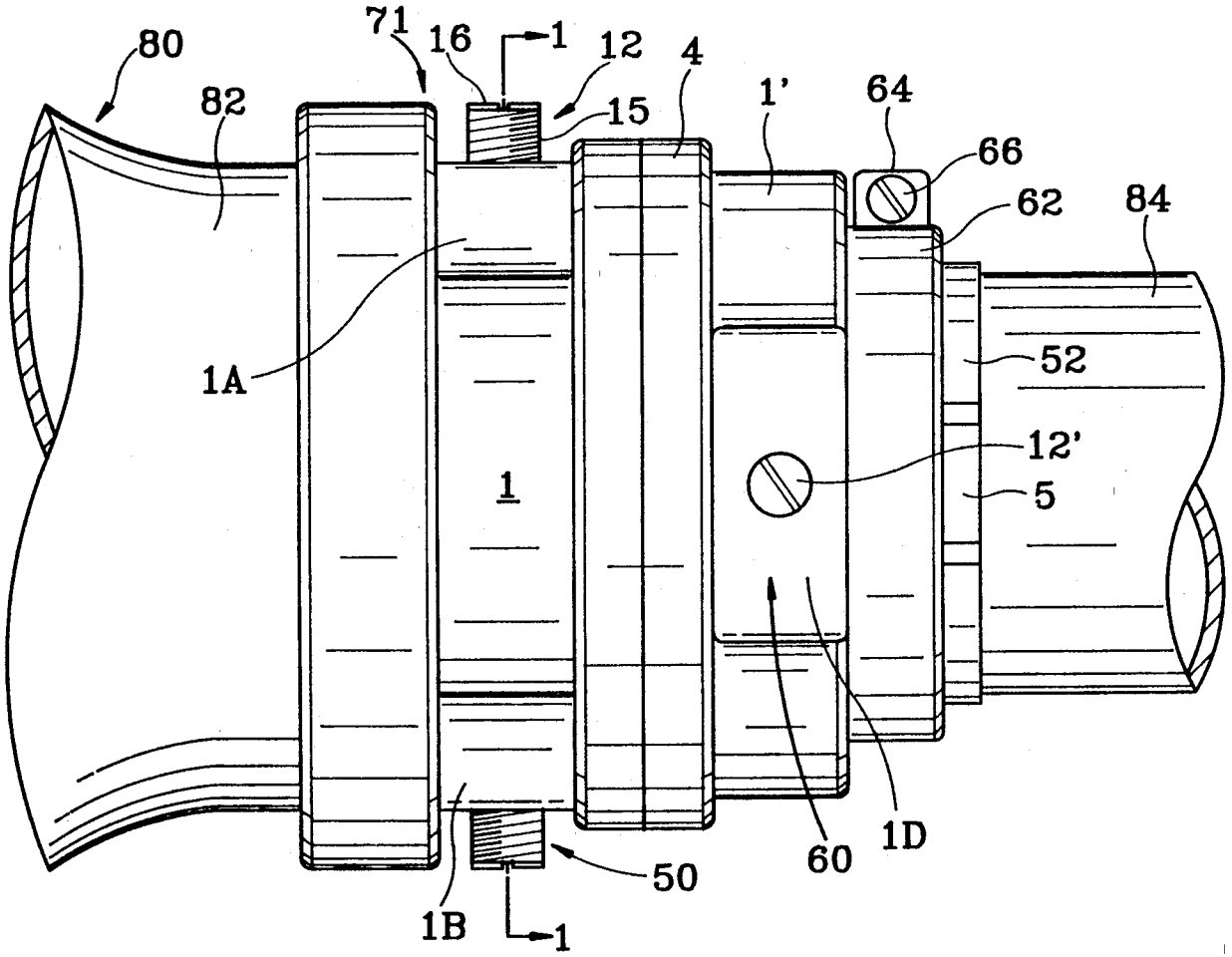
FIG. 2 is a side elevation view of the magnet assembly of FIG. 1 coupled to the neck portion of a cathode ray tube.

Preferably, two pairs of opposing units 1A–1D are used, a front pair 50 and a rear pair 60 as seen in FIGS. 1 and 2, the pairs 50, 60 being rotated or offset with respect to each other by an angle of 90°. Pair 50 includes unit 1A, 1B and pair 60 includes 1C, 1D. Units 1A and 1B are arranged diametrically opposite one another, as are units 1C and 1D. Thus, the circumference of holder 5 defines a circle around which units 1A, 1B, 1C, 1D are mounted, each separated by a 90° are segment of the circumference of holder 5. This arrangement of four units 1A–1D arranged around the yoke of a CRT enables correction of misconvergence in any direction.

In FIG. 1, each unit 1A, 1B, 1C, 1D includes identical internal structures, but for clarity, reference numerals are only shown for unit 1A.

A single housing 1 is used for each pair 1A, 1B and 1C, 1D. Laterally inwardly extending guides 13 are provided on the inner walls 14 of the supporting member 1, preventing bipolar magnet 2 from moving laterally within space 11. Preferably, adjusting means 12 is a threaded bolt or stud 15 having a slotted head 16 which receives a conventional screwdriver, so that fine adjustments of the up-and-down position of magnet 2 are possible.

According to the present embodiment, the compressible element 3 comprises inner and outer caps 31, 32 forming a telescoping capsule, and a spring 33. The elastic section 3 can be constituted in the form of a bellows. Outer cap 32 is constructed having an overall width greater than the overall width of inner cap 31, so that when spring 33 compresses under downward pressure by the stud 15, outer cap 32 is telescopically pushed down around the side walls of inner cap 31.

Thus, the correcting magnet 2 of each unit 1A–1D of the present invention can move closer to or further from the holder 5 of the electron gun by rotating the means 12, thereby causing element 3 to compress or expand, moving magnet 2.

In the above-described structure, the materials of all the components except magnet 2 are non-magnetic materials. This enables isolation of magnet 2 from the other components of the assembly, ensuring accurate and stable operation.

As shown in FIGS. 1 and 2, two pairs 50, 60 of units 1A–1D are axially installed on rear end 71 of deflection yoke 7 which is mounted on a neck portion 82 of a cathode ray tube 80. The color purity enhancing magnet 4 is sandwiched between magnet pairs 50, 60 which surround holder 5 of the electron gun (not shown mounted on a rear portion 84 of the CRT). At the rear of supporting structure 1' of units 1C, 1D of pair 60, a circular-type fastening strap or clamp 6 is provided which secures the convergence correcting magnet pairs 50, 60 of the present invention to the outer circumferential surface 52 of holder 5. Strap 6 preferably comprises a metal band 62 which encircles holder 5 and upstanding fastening tabs 64. A conventional screw 66 is threaded into tabs 64 to hold tabs 64, thereby fixing strap 60 tightly against pairs 50, 60.

Figure 3A:
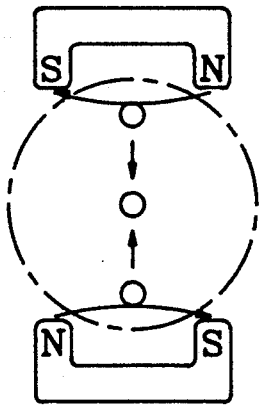
FIGS. 3A and 3B schematically illustrate the beam correcting effects obtained by pairs of correcting magnets of the present invention.
Figure 3B:
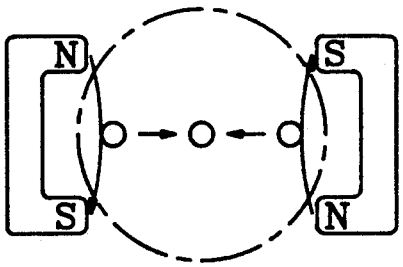

When the present invention is in operation, as shown in FIGS. 3A and 3B, electron beams R, G, B drifting in the longitudinal direction are forced toward the center beam by the vertical correcting magnets 2 of units 1A, 1B or pair 50, which create magnetic fields in the direction of arrows M1, M2. Electron beams drifting in the lateral direction converge toward the center beam G by magnets 2 in the left and right units 1C, 1D of pair 60 by magnetic fields flowing in the direction of arrows M3, M4.

To cause the laterally and longitudinally drifting beams R, B to converge exactly toward the center beam G, adjusting means 12 is finely adjusted to change the position of the magnets, thereby causing the intensity of the applied magnetic fields to be adjusted. Further, as an alternative method, the adjustment can be made by installing differently sized magnets.

According to the present invention as described above, the magnetic fields established in the lateral and longitudinal directions can be precisely adjusted, thereby permitting precise adjustment of the convergence characteristics of a color cathode ray tube.

What is claimed is:

1. A misconvergence correcting magnet assembly for an inline type color cathode ray tube, the tube including a generally cylindrical neck portion having an outer circumferential surface and a center axis, comprising:

four bipolar magnets arranged in front and rear pairs;

a first housing for mounting the front pair of bipolar magnets radially spaced from the center axis and circumferentially opposite one another; and a second housing for mounting the rear pair of bipolar magnets radially spaced from the center axis and circumferentially opposite one another, and each of the first and second housings containing means for adjusting a radial distance of the first and second pairs of bipolar magnets, respectively, from the center axis.

2. The assembly of claim 1, wherein each pair of magnets is mounted in a respective clearance space in each of the first and second housings, and each means for adjusting comprises means for moving each magnet in each pair of magnets toward or away from the neck portion.

3. The assembly of claim 2, wherein each of the means for adjusting comprises:

a compressible element mounted between the respective magnet in the respective pair of magnets and the neck portions; and an adjustment screw threaded through the respective housing, the screw having a top end protruding from the respective housing and a bottom end contacting the respective magnet in the respective pair of magnets.

4. The assembly of claim 2, wherein the rear pair of magnets is axially spaced apart from the front pair, and a color purity enhancing magnet is axially mounted between the front pair and the rear pair.

5. The assembly of claim 3, wherein each compressible element comprises:

a top cap contacting the magnet;

a bottom cap contacting the neck portion and telescopically received in the top cap; and a spring compressively mounted between the top cap and the bottom cap.

6. The assembly of claim 4, further including a generally circular fastening strap mounted axially rearwardly of the rear pair.

7. The assembly of claim 4, wherein the adjustment means comprises:

a top cap contacting the respective magnet;

a bottom cap contacting the neck portion and telescopically received in the top cap; and a spring compressively mounted between the top cap and the bottom cap.

8. The assembly of claim 5, further including guide means in each clearance space for preventing lateral movement of the respective magnet.

9. The assembly of claim 1, wherein the front and rear pairs of magnets are disposed in the first and second housings, respectively, with the rear pair of magnets circumferentially offset from the front pair of magnets.

10. The assembly of claim 9, wherein the front and rear pairs of magnets are circumferentially offset by 90°.

11. The assembly of claim 1, wherein the first and second housings are separate from each other.

* * * * *